US009851100B2

(12) United States Patent
Clarke et al.

(10) Patent No.: US 9,851,100 B2
(45) Date of Patent: Dec. 26, 2017

(54) WASTE TREATMENT APPARATUS AND METHOD

(71) Applicant: Pyropure Limited, Bordon, Hampshire (GB)

(72) Inventors: Howard Morgan Clarke, Petersfield (GB); Michael Benjamin Elder, Petersfield (GB)

(73) Assignee: PYROPURE LIMITED (GB)

( * ) Notice: Subject to any disclaimer, the term of this patent is extended or adjusted under 35 U.S.C. 154(b) by 0 days.

(21) Appl. No.: 14/925,219

(22) Filed: Oct. 28, 2015

(65) Prior Publication Data

US 2016/0109120 A1 Apr. 21, 2016

Related U.S. Application Data

(63) Continuation of application No. 13/664,548, filed on Oct. 31, 2012, now abandoned, which is a (Continued)

(30) Foreign Application Priority Data

Mar. 10, 2006 (GB) ..... 0604907.6

(51) Int. Cl.
*F23G 5/027* (2006.01)
*F23J 15/02* (2006.01)

(Continued)

(52) U.S. Cl.
CPC ..... *F23G 5/027* (2013.01); *F23G 5/40* (2013.01); *F23G 5/44* (2013.01); *F23J 15/022* (2013.01);

(Continued)

(58) Field of Classification Search
CPC .... F23J 1/00; F23J 2700/001; F23J 2700/003; F23J 2900/01005

(Continued)

(56) References Cited

U.S. PATENT DOCUMENTS 3,357,376 A 12/1967 Miller
3,682,139 A 8/1972 Sahm (Continued)

FOREIGN PATENT DOCUMENTS

CN 1418738 5/2003
DE 4339157 5/1995

(Continued)

OTHER PUBLICATIONS

International Search Report and Written Opinion for PCT/GB2007/000853, dated Sep. 18, 2007 from the International Searching Authority of the European Patent Office.

(Continued)

*Primary Examiner* — David J Laux
(74) *Attorney, Agent, or Firm* — Finnegan, Henderson, Farabow, Garrett and Dunner LLP

(57) ABSTRACT

In apparatus and method for waste treatment by pyrolysis, treated waste is flushed through a grid (18) to trap recyclable material in the pyrolysis chamber (24). Pyrolysis is carried out at a temperature of from 400-700° C. and off-gases are dissolved in a solution in scrubber (13) for disposal in a water course. Water is introduced into the chamber as superheated steam via pipes (5) so as both to flush away treated material and clean the chamber. Recyclable waste is separated from non-recyclable by treating non-recyclable waste by pyrolysis, and flushing treated non-recyclable waste away through liquid exhaust (8). Apparatus is made as a modular, free-standing unit and comprises plugs for connection to an electricity supply, to a water supply, and to a (Continued)

sewerage system (16) and has a chamber with a volume in the range 0.01-0.5 $m^3$.

20 Claims, 2 Drawing Sheets

Related U.S. Application Data continuation of application No. 12/282,334, filed as application No. PCT/GB2007/000853 on Mar. 12, 2007, now Pat. No. 8,307,770.

(51) Int. Cl.
*F23G 5/44* (2006.01)
*F23G 5/40* (2006.01)
*F23J 15/04* (2006.01)

(52) U.S. Cl.
CPC ..... *F23J 15/04* (2013.01); *F23G 2200/00* (2013.01); *F23G 2201/30* (2013.01); *F23G 2203/70* (2013.01)

(58) Field of Classification Search
USPC ..... 110/229, 230, 231; 122/405; 134/108, 134/166 R, 169 R, 150
See application file for complete search history.

(56) References Cited

U.S. PATENT DOCUMENTS

| | | | | |
|---|---|---|---|---|
| 3,779,182 | A | 12/1973 | Comacho | |
| 4,706,560 | A | 11/1987 | Capodicasa | |
| 4,718,358 | A | 1/1988 | Nomi et al. | |
| 4,999,167 | A | 3/1991 | Skelley et al. | |
| 5,095,829 | A * | 3/1992 | Nevels | F23G 5/006 110/211 |
| 5,191,184 | A * | 3/1993 | Shin | F23G 5/085 110/250 |
| 5,363,777 | A | 11/1994 | Yoshimoto et al. | |
| 5,713,290 | A * | 2/1998 | Huang | F23G 5/245 110/214 |
| 5,826,520 | A | 10/1998 | Mainord | |
| 5,890,443 | A | 4/1999 | Taya et al. | |
| 6,360,679 | B1 * | 3/2002 | Clarke | A61L 11/00 110/219 |
| 8,307,770 | B2 * | 11/2012 | Clarke | F23G 5/027 110/171 |
| 2003/0183137 | A1 | 10/2003 | Martin et al. | |
| 2004/0168621 | A1 | 9/2004 | Jeulin | |
| 2005/0145241 | A1 | 7/2005 | Jordens et al. | |
| 2005/0214187 | A1 | 9/2005 | Johnson | |
| 2005/0223954 | A1 | 10/2005 | Forsberg | |

FOREIGN PATENT DOCUMENTS

| | | |
|---|---|---|
| EP | 0486728 | 11/1990 |
| EP | 0505278 | 9/1992 |
| EP | 0610120 | 8/1994 |
| EP | 0692677 | 1/1996 |
| EP | 0724008 | 7/1996 |
| EP | 1371713 | 12/2003 |
| FR | 2820753 | 8/2002 |
| GB | 110275 | 10/1917 |
| GB | 1046369 | 10/1966 |
| GB | 1061420 | 3/1967 |
| GB | 2173885 | 10/1986 |
| GB | 2265446 | 9/1993 |
| GB | 2274908 | 8/1994 |
| GB | 2289324 | 11/1995 |
| GB | 2310485 | 8/1997 |
| JP | 60105815 | 6/1985 |
| JP | 1-263411 | 10/1989 |
| JP | 6-117617 | 4/1994 |
| JP | 07-055121 | 3/1995 |
| JP | 8-229533 | 9/1996 |
| JP | 11-071590 | 3/1999 |
| JP | 2001-062437 | 3/2001 |
| JP | 2001-137824 | 5/2001 |
| JP | 2001-327950 | 11/2001 |
| JP | 2002-081623 | 3/2002 |
| JP | 2002-526740 | 8/2002 |
| JP | 2005-029728 | 2/2005 |
| JP | 2005-140346 | 6/2005 |
| JP | 2005-195228 | 7/2005 |
| WO | WO 95/14191 | 5/1995 |
| WO | WO 00/20801 | 4/2000 |
| WO | WO 02/40618 | 5/2002 |
| WO | WO 03/012338 | 2/2003 |
| WO | WO 2005/066542 | 7/2005 |

OTHER PUBLICATIONS

Notification of Reasons for Refusal issued by the Japanese Patent Office dated Feb. 14, 2012, in Japanese patent application No. 2008-558886.

Search Report issued in Great Britain Application No. 0604907.6 dated Jul. 25, 2006.

Search Report relating to claims 45-57 issued in Great Britain Application No. 0604907.6 dated Jan. 16, 2007.

Search Report relating to claims 59-62 issued in Great Britain Application No. 0604907.6 dated Jan. 16, 2007.

Second Office Action issued by the Chinese Patent Office dated Apr. 19, 2012, in Chinese patent application No. 200780008362.3.

Non-Final Office Action for Korean Patent Application No. 10-2008-7022080 dated Jun. 23, 2013, 7 pages.

* cited by examiner

WASTE TREATMENT APPARATUS AND METHOD

This is a continuation of application Ser. No. 13/664,548, filed Oct. 31, 2012, which is a continuation of application Ser. No. 12/282,334, filed Oct. 7, 2008, which is a National Stage Entry of PCT/GB2007/000853 filed Mar. 12, 2007, and claims priority to United Kingdom Patent Application No. GB 0604907.6, filed on Mar. 10, 2006, all of which are incorporated herein by reference.

The present invention relates to waste treatment apparatus and method, in particular apparatus and method for treatment of waste from a range of sources, including commercial premises and domestic and multi-occupancy residences.

Pyrolysis for the disposal of domestic (sanitary) waste is known from WO 00/20801. Small pyrolysis units are installed on ships for processing minor quantities of sanitary waste. These units use a multi-step process, requiring a vacuum pump to evacuate air before beginning pyrolysis and to actively evacuate residue from the unit following waste treatment. In addition to only processing small amounts of homologous sanitary waste the units are situated in close proximity to the user, often within a toilet cubicle.

Large scale industrial pyrolysis of waste is known from inter alia, US 2004/0168621, EP 0724008, EP 692677, EP 0505278, and EP 0610120. Industrial size pyrolysis plants require waste to be transported to them. They operate continuously at high temperatures and due to instantaneous exposure to these high temperatures and the types of waste that are processed, these plants tend to produce large quantities of noxious gases, including dioxins. These off gases are typically passed to a combustion chamber. Exhaust gases from this chamber are then optionally subjected to additional processing before release to the atmosphere, or may be diverted to supply heat within the unit.

Smaller scale pyrolysis is also known from inter alia; JP 2005140346, JP 2002081623, JP 2001062437, JP 60105815, EP 1371713, U.S. Pat. No. 3,779,182, WO 02/40618, GB 2289324, and GB 2310485.

Pyrolysis is also known in relation to domestic ovens, for example in the self cleaning mechanism of US 2005/0145241.

Municipal waste disposal is a growing problem, with the majority of this waste being buried in landfill sites. A need to reduce the volume of waste for disposal is leading to an increased drive to recycle. In regard to domestic waste this requires a level of compliance from residents and has varying levels of success.

Suitable locations for new landfill sites are relatively uncommon due to strict hydro-geological requirements, avoidance of water table contamination and other environmental considerations. In short, there is an increasing scarcity of suitable waste burial sites and an urgent need for alternative methods of waste disposal.

Incineration is one of the more widely used alternatives to landfill, however, this requires the production of large scale industrial plants, a time consuming and expensive process. Additionally, public opinion is often against the building of these plants, particularly on the basis of objections to gas release into the local area. The fumes produced by waste combustion are unavoidable and necessitate the incorporation of complex gas processing mechanisms to remove pollutants.

Waste pyrolysis is an alternative to landfill and incineration, but requires continuously operating industrial pyrolysis plants. Waste has to be collected and transported to these plants before being processed. Due to the heterogeneity of waste being processed and the high pyrolytic temperatures toxic emissions are commonly produced. It is not desirable to release these to the atmosphere and thus, as for incineration plants, complex gas processing systems have to be incorporated into plants.

It is an object of the invention to provide a process and apparatus to treat waste on site on a domestic and large domestic scale. It is an object of specific embodiments of the invention to do so for multi-occupancy residences and also individual domestic residences and commercial enterprises such as supermarkets and restaurants. A further object is to reduce and/or remove the need for the transport of waste and prevent waste ending up as landfill, allowing local authorities to meet the requirements of recycling directives. A still further object of the invention is to enable greater efficiency in collecting recyclable materials, improving public compliance by facilitating the recycling process.

Accordingly, the invention provides a process for waste treatment and apparatus for carrying out waste treatment by a combination of pyrolysis and combustion steps, the process and apparatus incorporating one or more, in any and all combinations, or all of the aspects of the invention described herein.

A first aspect of the invention comprises a process for waste treatment by pyrolysis and combustion, wherein treated waste is flushed through a grid to trap recyclable material. Apparatus of this aspect comprises a pyrolysis chamber having a grid between a waste treatment zone and an exit from the chamber.

A second aspect of the invention comprises pyrolysis of waste at a temperature of from 400-700° C.

A third aspect of the invention comprises dissolving off-gases generated by pyrolysis and combustion in a solution and disposing of the solution, for example in a sewer. Apparatus of this aspect comprises a tank containing a gas treatment solution, an exhaust port for exit of gases from the pyrolysis chamber and a conduit arranged in combination with the tank such that the gases exiting the chamber are dissolved in the solution, which can then be disposed of.

A fourth aspect of the invention comprises introducing water into the chamber as superheated steam so as both to flush away treated material and clean the chamber. Apparatus for this aspect comprises pipework in walls of the chamber via which in use water enters the chamber, the water being heated by the hot chamber walls and entering the chamber as superheated steam.

A fifth aspect of the invention provides for separation of recyclable waste from non-recyclable waste in mixed waste comprising treating non-recyclable waste in the mixed waste by pyrolysis and combustion, and flushing treated non-recyclable waste away whilst retaining recyclable waste.

A sixth aspect of the invention is a modular pyrolysis and combustion apparatus, which is free-standing and comprises plugs for connection to an electricity supply, to a water supply, and to a sewerage system.

A seventh aspect of the invention is a pyrolysis and combustion apparatus having a chamber with a volume in the range from 0.01-0.5 $m^3$.

In more detail, a first aspect of the invention provides a process for waste treatment comprising introducing waste into a chamber, heating the waste to an elevated temperature to effect pyrolysis of the waste, introducing oxygen into the chamber to effect combustion of the waste, and flushing the combusted waste from the chamber with water, wherein the combusted waste is flushed through a grid to trap recyclable material. Treated waste is mostly fine ash and is easily washed through the grid and away into e.g. a sewer or other water course. Waste is thus treated on site.

The grid can be located outside the chamber, for example between an exit from the chamber and an entrance into the water course. But, it is preferably located in the chamber, conveniently forming a or part of a shelf, and the method can comprise placing waste introduced into the chamber on the grid.

The method enables separation of recyclable waste, and can therefore comprise transferring recyclable material from the grid to a receptacle outside the chamber. Collected recyclable material can be taken away for recycling—again, avoiding unnecessary land-fill use. The term "recyclable waste" herein refers to commonly recyclable materials that are not reduced to ash following a waste treatment cycle of the invention; typically these materials are metal and glass.

The grid is hence preferably moveable, and the method preferably comprises moving the grid between a first position in which the grid traps the recyclable material and a second position in which the recyclable material can be transferred into a receptacle. The grid can thus easily, and optionally automatically, be emptied, whether once a pyrolysis cycle or after several cycles of waste treatment. For operator convenience, the grid may be operated via a control system, such as one associated with automatic monitoring and operation of the apparatus.

In a further embodiment, the method comprises agitating the grid during pyrolysis of the waste. This can assist transfer of heat into the middle of the waste and thus assist more complete pyrolysis of all waste in the chamber.

Pyrolysis and combustion apparatus of this aspect comprises a sealable chamber, a waste treatment zone in the chamber, a port for introducing waste into the chamber, a port for the exit of treated waste, a heating element, and a grid between the waste treatment zone and the exit port. In use, non-treated material, which generally contains a high proportion of recyclable material, such as glass and metal, is caught and not flushed away but can instead be recycled.

Suitably, the grid forms a shelf across the chamber to support the waste being treated. The grid can also be or be part of a basket in the chamber. The grid can thus be used to locate and/or hold waste in the treatment zone during pyrolysis. In an apparatus described in more detail below, the grid forms a shelf towards the bottom of the chamber and a little raised from the floor of the chamber. Waste lies on and is supported by the shelf. After treatment by pyrolysis and combustion water flushes the resultant ash through the grid onto the floor and then out of the chamber, large particles typically of undegraded material, being trapped. The floor is generally angled down towards a valved exit port where water exits the chamber.

The grid is preferably moveable between a first position in which it traps undegraded material during flushing of the chamber and a second position in which the undegraded material can be transferred to a receptacle outside the chamber. This facilitates emptying of the recyclables from the chamber.

A control apparatus for moving the grid between the first and second positions and a mechanism for agitation of the grid can be associated with the grid.

A purpose of the grid is to trap particulate material and not allow this into the water course, whilst allowing the ash residue to be easily flushed away. To this end, the grid may comprise a plurality of apertures sized 15 mm or less in diameter, 10 mm or less in diameter, 7 mm or less in diameter or 5 mm or less in diameter. In a particular embodiment, the grid comprises a plurality of apertures sized about 3 mm in diameter. Generally the apertures can be of any shape, though round or square apertures are more typical. The grid apertures should not be so fine that they are clogged in use by the ash residue of the waste treatment cycle, and so are preferably at least 1 mm, more preferably at least 2 mm in diameter.

The apparatus can also comprise a combination of two or more grids. For example, there may be a first grid having a plurality of apertures of a first size, and a second grid between the first grid and the exit port and having a plurality of apertures of a second size, wherein the first size is bigger than the second size. This second, smaller aperture grid, with apertures typically 2 mm or more, or 3 mm or more smaller than those of the first, and located closer to the exit of the chamber separates trapped material into two divisions by size and can prevent or reduce the clogging when there is just one. Suitable aperture combinations are first grid—15 mm or less, second grid—10 mm or less, preferably 7 mm or less, or first grid—12 mm or less, second grid—10 mm or less, preferably 7 mm or less, or first grid—12 mm or less, second grid—7 mm or less, preferably 5 mm or less.

The grid may also be or form part of a basket within the chamber and preferably removable from the chamber. In use, waste is conveniently placed in the basket outside the chamber and the basket, now holding the waste, placed into the chamber to be treated.

A process for waste treatment in accordance with a second aspect of the invention comprises introducing waste into a chamber, heating the waste to an elevated temperature to effect pyrolysis of the waste, introducing oxygen into the chamber to effect combustion of the waste, and flushing the combusted waste from the chamber with water, wherein the elevated temperature to effect pyrolysis is from 400-700° C. Operating at these temperatures with rapid cooling of the chamber and its contents once treatment is finished and using a relatively short treatment cycle time tends to avoid formation of some of the more noxious contaminants associated with standard pyrolysis units or form them to a lesser degree, whilst ensuring that substantially all waste, other than recyclable components, can be treated. Hence an advantage of the invention is that scrubbing of off gases can be carried out with reduced on-site emissions, and a particularly preferred embodiment of the invention can be operated with substantially zero emissions on site—off gases being vented away from the apparatus, e.g. via vents in the sewer system.

The pyrolysis temperature is preferably from 500-700° C., more preferably from 500-600° C. In a specific embodiment of the process, described in more detail below, the system operates at about 550° C.

It is further preferred that combustion is carried out at elevated temperatures, typically 400° C. or higher, preferably at least 450° C. more preferably at least 500° C. In typical operation of an apparatus of the invention, the chamber is heated to the pyrolysis temperature and then combustion is carried out as the next step without specific separate heating or cooling of the chamber. Heat generated by combustion generally maintains an elevated temperature within the waste and depending upon its calorific content may slightly increase the temperature so chamber heaters are generally turned off during combustion. Heat can be removed from the chamber by passing off gases through a radiator or a heat exchanger and recovered heat can be used for other purposes. Chamber temperature can also be controlled by controlling flow of air into the chamber. Generally chamber temperature during combustion does not rise above 800° C. and preferably not above 750° C. or 700° C.

In a particular embodiment of the invention comprising a large chamber volume an air circulation device, preferably comprising a fan, is included to disperse the warm air evenly throughout the chamber as the chamber is being heated in preparation for pyrolysis. Air can be heated or reheated by heaters in the circulation path. This ensures that the heat is directed into the waste load more effectively—thus speeding up its degradation during pyrolysis. Air circulation may continue during pyrolysis and/or combustion phases. In smaller chambers the reduced waste load tends to allow heat to penetrate sufficiently rapidly without the need for air circulation.

The duration of the pyrolysis phase varies according to waste volume, with a limit dictated by chamber volume. Apparatus of the invention are generally designed for use in domestic and multi-occupancy residences and small commercial premises. Waste generally enters the chamber at ambient temperature, the chamber is then sealed and the heaters are activated to heat the chamber to the operating temperature. In apparatus made and tested to date, this heating phase typically takes 2-20 minutes, preferably 5-10 minutes, being dependent on the operating temperature required, the chamber volume, and volume of waste in the chamber. In use, it is found that off-gases can evolve in fractions as the temperature increases and this is believed to result in reduced production of certain toxic components, notably dioxins and fluorins compared to industrial pyrolysis. Processes carried out in such apparatus generally comprise holding the waste at the elevated temperature for 10-90 minutes, preferably for 20-60 minutes. In a specific embodiment of the process, described in more detail below, the pyrolysis phase has a roughly 30 minute duration.

In some embodiments of the invention intelligent timing systems are used to control the length of the cycle. These systems can monitor the temperature of the off-gases being produced and adjust the cycle duration accordingly. Use of these systems improves the power efficiency of the process. In one example, a control system monitors the temperature of the off-gases or of the load, such as via a thermocouple located proximal to the waste in the chamber, and triggers commencement of combustion once a predetermined temperature (say, about 450° C.-500° C.) is reached. In another example, a control system monitors the temperature of the off gases from the chamber and when the temperature has dropped to a pre-determined level (say 300° C.-400° C.) initiates the end of the combustion and the beginning of cooling and cleaning of the chamber by introduction of water (as superheated steam). Another option is to monitor the rate of cooling of the chamber, and once this reaches or approaches the natural cooling rate of the chamber, then initiate the end of combustion.

In an example of the invention operating in situ, the apparatus is set up with a pre-programmed pyrolysis phase, based on the chamber volume and anticipated nature of the waste to be processed. The phase may be set up such that the elevated temperature is held for the duration of the pyrolysis phase and such that 50% or more of the waste is degraded, preferably 70% or more, more preferably 80% or more. In practice it is problematic and energy inefficient to ensure 100% treatment, especially when recyclable material is present such as metals and glass, which would not be degraded and which can be extracted for recycling. From expected waste volume and content the system may be set up for a given property so that from 60%-95% of waste by weight is pyrolysed.

In a third aspect of the invention a process for waste treatment comprises introducing waste into a chamber, heating the waste to an elevated temperature to effect pyrolysis of the waste, introducing oxygen into the chamber to effect combustion of the waste, flushing the combusted waste from the chamber with water, dissolving gases generated by the pyrolysis and/or combustion in solution, and disposing of the solution. Hence, rather than emit these gases or subject them to treatment by combustion the gases are dissolved.

A disadvantage of known pyrolysis plants and incinerators is the generation of dioxins and fluorins by initial phases of waste treatment, dealt with by combustion of off-gases, generating intense heat. Planning objections on environmental grounds are raised due to the risk that inadequate combustion will release toxic chemicals into the atmosphere. In the present invention it is found that levels of dioxins, florins and other contaminants, carried away in the water flushed through the chamber are acceptably low and so low as not to pose environmental problems, or at least fewer than when such components are combusted. Disposal in a water course is easy and not unsightly and does not release contaminants into the immediate vicinity of the pyrolysis plant. The solution can be discharged into the sewerage system.

In use of a specific embodiment of the invention far fewer noxious gases are produced than would usually be expected following pyrolysis and/or combustion. Factors implicated in this unexpected result are believed to be related to the indirect heating of the waste from an ambient temperature (below 100° C.) combined with the relatively low maximum temperature and rapid cooling phase.

Waste gases produced by pyrolysis and/or combustion are suitably passed through an aqueous agitation system, to assist dissolution of gases. Gases can be bubbled through the solution, optionally containing softened water and optionally containing additives to promote dissolution of the gases.

Not all gases may be dissolved in the solution and it is preferred that gases are subsequently filtered within a gas cleaning chamber. The method also may comprise discharging undissolved gases into the sewage system. Hence, in an embodiment, filtered exhaust gases that have not been dissolved in solution or retained within the filter are discharged into the sewer. These gases then pass up the soil pipe to vent through venting stacks. The filtered exhaust produced is substantially colourless and odourless, principally consisting of carbon dioxide and carbon monoxide for example.

In preferred embodiments, all of the by-products of the process are disposed of into the sewer.

A further but associated process of the invention, for waste treatment in a cycle, comprises providing fresh solution for dissolving gases generated by pyrolysis and/or combustion, carrying out a waste treatment process according to the invention, including dissolving off-gases in the solution and disposing of the now used solution, and repeating the cycle. The process may include monitoring generation of waste gases within the chamber and triggering flushing combusted material from the chamber after the generation of waste gases has fallen below a predetermined temperature. Evolution of gases diminishes as the process approaches completion, so monitoring gases is an efficient means of tracking when there is little waste left to be treated.

A pyrolysis apparatus of this aspect comprises a sealable chamber, a waste treatment zone in the chamber, a port for introducing waste into the chamber, a port for the exit of treated waste, and a heating element, the apparatus further comprising a tank to contain a gas treatment solution, an exhaust port for exit of gases from the chamber and a conduit arranged in combination with the tank and the exhaust port such that the gases exiting the chamber are contacted with and can be dissolved in the solution.

In an embodiment of the invention set out below, the conduit bubbles the gases through the solution. Another arrangement is for the gases to pass through an atmosphere saturated with vapour from the solution or for gases to be combined with droplets of the solution, for example by passing the gases through a spray of the solution. Solution containing dissolved gases is returned to or retained within the tank, which can be emptied as part of a cycle or separately.

A gas cleaning chamber comprising a filter for filtration of gases not dissolved in the solution is optionally downstream of the conduit. The gas filter used in an example comprises carbon granules, and the filter is suitably removable, for example to enable washing and reuse. Preferably the filter is a ceramic filter. Typically the filter is changed annually. Used filters can be disposed of via a specialist landfill site.

A fourth aspect of the invention provides a process for waste treatment comprising introducing waste into a chamber, heating the waste to an elevated temperature to effect pyrolysis of the waste, introducing oxygen into the chamber to effect combustion of the waste, and flushing the combusted waste from the chamber with water, wherein the water is introduced into the chamber as superheated steam.

In use, the steam cools and cleans the chamber and flushes away the ash residue of treated material. This is convenient and efficient. The chamber is left looking clean and hence more acceptable for users. There is reduced risk of residue in the chamber which is unsightly or has unpleasant odour.

To carry out the flushing, water can be introduced into the chamber via piping in walls of the chamber, the water being heated to form superheated steam as it passes through the piping. In this way the water is heated to the desired temperature by the chamber heat. Also, the chamber is cooled in readiness for a next cycle of use.

The combustion phase includes a step of allowing access of oxygen to material in the chamber, typically supplied as air. The process preferably comprises introducing oxygen into the chamber via piping in walls of the chamber and subsequently introducing water into the chamber via the same piping. This efficiently uses common piping, simplifying system design. Piping can be in the walls, outside the walls or in the chamber. The pipe work for the introduction of oxygen (in air) and, later water, to the chamber generally has a diameter in the range of 3-15 mm, more preferably from 5-8 mm.

A large volume of steam is generated from a small volume of water, so the process is efficient compared to use of water only for the flushing. The chamber may thus be flushed with a volume of water which is 50% or less of the volume of the chamber, preferably 35% or less of the volume of the chamber.

In an example set out below, the process comprises introducing the superheated steam into the chamber through a. nozzle which directs the steam at the combusted waste. This can help break down the structure of the residue and aid flushing of the chamber.

The process can also or separately comprise introducing the steam into the chamber via a nozzle which directs the steam at the walls of the chamber. This can help clean chamber walls and aid flushing.

In a preferred arrangement, the process comprises introducing the steam into the chamber via a plurality of nozzles directed, inter alia, at the combusted material (i.e. towards the position in the chamber where the material is expected to be) and at the walls of the chamber. The steam is preferably introduced into the chamber via a moveable jet.

Apparatus of this aspect comprises a sealable chamber, a waste treatment zone in the chamber, a port for introducing waste into the chamber, a port for the exit of treated waste, a heating element, a water tank, and a conduit between the water tank and the chamber passing via pipework in walls of the chamber so that in use water entering the chamber is heated by the chamber walls and enters the chamber as superheated steam.

One or more nozzles, preferably fixed, may be provided for direction of the steam entering the chamber.

An oxygen supply (generally as air) is preferably linked by piping to the chamber and arranged such that in use oxygen is supplied to the chamber via the piping, and, subsequently, water is supplied to the chamber via the same piping. Flow rates vary with factors including chamber size and we have operated embodiments with air flow rates of from 25-200 liters/min.

A fifth aspect of the invention provides a process for separation of recyclable waste from non-recyclable waste in mixed waste comprising introducing the mixed waste into a chamber, heating the mixed waste to an elevated temperature to effect pyrolysis of the non-recyclable waste, introducing oxygen into the chamber to effect combustion of the non-recyclable waste, flushing the combusted waste from the chamber with water whilst retaining the recyclable waste in the chamber, and transferring the retained recyclable waste to a separate container.

A sixth aspect of the invention provides a modular pyrolysis and combustion apparatus comprising a sealable chamber, a waste treatment zone. In the chamber, a port for introducing waste into the chamber, a port for the exit of treated waste, and a heating element, wherein the apparatus is free-standing and comprises plugs for connection to an electricity supply, to a water supply, and to a sewerage system.

An apparatus for domestic or small business use may comprise a plug for connection to a mains electricity supply. Bigger apparatus may connect to a 3-phase supply.

A water softening unit is generally part of the apparatus, as are retractable wheels for ease of installation and removal.

A seventh aspect of the invention provides a pyrolysis apparatus comprising a sealable chamber, a waste treatment zone in the chamber, a port for introducing waste into the chamber, a port for the exit of treated waste, and a heating element, wherein the chamber volume is in the range from 0.01-0.50 $m^3$.

The chamber volume is preferably in the range from 0.02-0.30 $m^3$, more preferably from 0.03-0.20 $m^3$ or from 0.04-0.10 $m^3$. Chambers with volumes of about 0.06 $m^3$ and about 0.14 $m^3$ have been successfully tested to date.

In embodiments of the invention, two or more aspects of the invention are combined in a particular process or apparatus. Very preferred methods comprise methods of all aspects of the invention and very preferred apparatus comprise apparatus of all aspects of the invention.

An apparatus of the invention for use in multi-occupancy dwellings comprises a sealable destruction chamber, the walls of which are formed of heat resistant materials, for example, of stainless steel and may include: a heating element, generally of an ohmic type; a reflective layer (to reflect heat towards the core of the chamber); an insulation layer; and a water jacket (to cool the outside surface). The chamber itself normally contains a safety system, such as pressure release valves, to operate in the event of the internal pressure breaching a predetermined threshold. The chamber is typically rounded, and may be circular or oval in shape.

The lid of the chamber is preferably heavily insulated and usually forms an airtight boundary with the chamber. Typically this is achieved through the use of seals which can be formed of a rubber material and the lid may contain a cooling system for the protection of these seals.

The chamber of one embodiment has an approximately 500 mm diameter with a depth of approximately 650 mm giving a capacity of approximately 130 liters (0.13 $m^3$); this will accommodate 2 or 3 white rubbish sacks. As chamber size and/or percent fill increases, effective transfer of heat to the core of the chamber becomes compromised; optionally the contents are agitated to ensure effective dissipation of heat.

This apparatus is suitable for multi-occupancy residences and generally requires a 3 phase electricity supply. In a smaller domestic setting a smaller chamber uses less power and so 3 KW heating elements are sufficient.

An output from the chamber is normally connected to the sewer, typically via a valved pipe, preferably of a 75-100 mm diameter. The valve is placed at some distance from the destruction chamber to prevent exposure to high temperatures e.g. greater than 100° C. A separate pipe connects the destruction chamber via a radiator or heat exchanger to a combination of one or more gas scrubbing and gas cleaning chambers. These preferably utilise softened tap water in a closed cycle and typically vent gases to the atmosphere via a sewer connection, downstream of the aforementioned valve. The gas scrubbing chamber typically uses about 4 liters of water and is usually refilled with clean water before each pyrolysis cycle. The primary function of the radiator is to cool off-gases prior to scrubbing and filtration. The radiator facilitates heat loss from the passing gases such that they are cooled from approximately 600° C. to 200° C., and are preferably cooled to below 100° C. The radiator can be used to recycle heat for other purposes, such as to heat water for domestic washing or heating.

The gas scrubbing and gas cleaning chambers control two phases of gas output. Preferably gas scrubbing is the first phase, comprising a water agitation system which causes gas contaminants to dissolve into solution. Preferably gas cleaning is the second phase, utilising a carbon filter containing carbon granules. Generally this filter is removable; it may be washed and reused at intervals. More preferably a ceramic filter, with or without coating, is used. This can be changed annually.

The process works at elevated temperatures to enable pyrolysis, these typically range from 400-700° C., more typically from 500-600° C., and in a specific embodiment the invention operates at about 550° C. This temperature is found to enable structural breakdown of the contents. Lower temperatures may result in incomplete breakdown of certain waste products such as bone, while higher temperatures may produce more noxious gases and lead to problems with emissions or the materials used for the structure of the machine.

An option, especially when the load has a relatively high moisture content, is to add an extra initial step of maintaining the load at a temperature at about 100° C. to drive off the excess water. Thus, the heaters can be maintained at, say, about 150° C.-200° C. and the temperature of the chamber monitored. Once the temperature begins to rise above 100° C., indicating that the moisture content is reduced to a considerably lower level, the heaters can then be increased e.g. to 500° C.

Water is introduced into the chamber following the combustion phase, and is preferably softened tap water; this prevents the build up of lime scale deposits. The resulting hot water may be discharged to the sewer, diverted into a domestic heating system or used to preheat the next load. Further optionally water may be diverted from the outer water jacket to the destruction chamber following pyrolysis.

In a typical operation of the apparatus, waste enters the destruction chamber and the lid is sealed, the chamber is then heated, to about 550° C. The off-gases produced during pyrolysis are monitored; as waste is destroyed the levels of these gases reduce, once they drop below a predetermined threshold the heaters are switched off. Air is then passed through the heating coil and admitted into the chamber, this is at approximately 500° C.+ on entry. Entry of the air initiates combustion of the residual waste within the destruction chamber. No external heat is applied at this stage but the heat from the pyrolysis stage is retained. The incoming airflow is maintained at approximately 100 liters/min, as higher flow rates may cause the chamber temperature to rise unacceptably. Gas output is monitored during combustion, and while waste is present the chamber output exceeds the air input. When the gas output drops below a set threshold the airflow is shut off and 6-7 liters of water are introduced through the pipe system. More water may be required for larger loads. The water enters the chamber at approximately 500° C.+ as superheated steam and Inconel™ pipe work is used within the machine in order to withstand the thermal shock of this process. Entry of the superheated steam results in a rush of gas, so the sewer connection is opened immediately prior to introduction of the steam. The steam cleans the inside of the chamber and washes the ash products into the sewer. Non-combusted material is retained by the metal grid, this can be removed for recycling or left in the machine for another cycle(s). Some pyrolyzable material may require two or three cycles before it is completely destroyed. Approximately 1 minute after the introduction of the steam the internal temperature of the destruction chamber has reduced to below 100° C. and the lid can be safely opened and the apparatus used again.

Unpyrolysed waste may be retained in the destruction chamber following completion of the pyrolysis cycle due to the location of one or more grids in front of the chamber output. In use, glass and/or metal in the waste is not destroyed by the pyrolysis and after the chamber is flushed with steam/water the glass and/or metal is captured in the grid. The grid apertures are designed to allow ash from treated waste to pass through and so are generally at least 1 mm in diameter; in more detail, the apertures are generally approximately square or approximately circular with dimensions of about 10 mm×10 mm if square or having a diameter of 10 mm if round, or less, preferably being about 7 mm×7 mm or about 7 mm in diameter, or less, more preferably about 5 mm×5 mm or about 5 mm in diameter or less. In a specific embodiment, grid apertures of dimension about 3 mm×3 mm have been used. Said grids may be removed from the machine on completion of a pyrolysis cycle to transfer unprocessed material to a separate receptacle, and this removal may be carried out manually or as part of an automated process.

The apparatus can suitably be adaptable to fit existing facilities in buildings and it may prove desirable to limit (the size of) objects that can enter the system. Accordingly the apparatus may include a feeding device to restrict the dimensions of material that can be introduced to the system. Optionally, the invention may include an apparatus to agitate the contents of the destruction chamber during pyrolysis in order to aid effective heat distribution. Further optionally, the invention may include a mechanism to prevent or mitigate the direct impact of waste into the destruction chamber.

Waste production/disposal is known to be intermittent; it is desirable for the invention to be able to effectively manage 'busy' and 'quiet' times. Accordingly the invention may include an apparatus to control waste input, preferably this is in the form of a buffer storage system, and optionally this may comprise a storage hopper and/or conveyor belt.

An apparatus of the invention is used for destruction of waste in a multi-occupancy dwelling. This invention removes the need for the transport of waste from the site of production to sites of destruction/disposal. It further reduces the demand on landfill sites and allows local authorities to comply with impending European directives on waste disposal.

The invention can provide a method of low gaseous emission pyrolysis. Due to the gradual (rather than instantaneous) exposure of the load to heat, the waste content and the comparatively low temperatures required for pyrolysis of this waste, fewer noxious chemicals are produced in comparison to industrial scale pyrolysis. Those dioxins and fluorins which are produced during pyrolysis are relatively water soluble and thus, following gas processing, are at acceptable levels for disposal via the sewer.

The pyrolysis system can be adapted according to the individual customer; the type and amount of waste dictate the required size of the unit and the temperatures needed. In an example described below the apparatus and process are controlled by a programmable logic controller. Preferably, subsequent embodiments of the invention will utilise a microprocessor for this action, as this will reduce production costs.

The invention is now illustrated in the following specific embodiment with reference to the accompanying drawings in which:—

Figure 1:
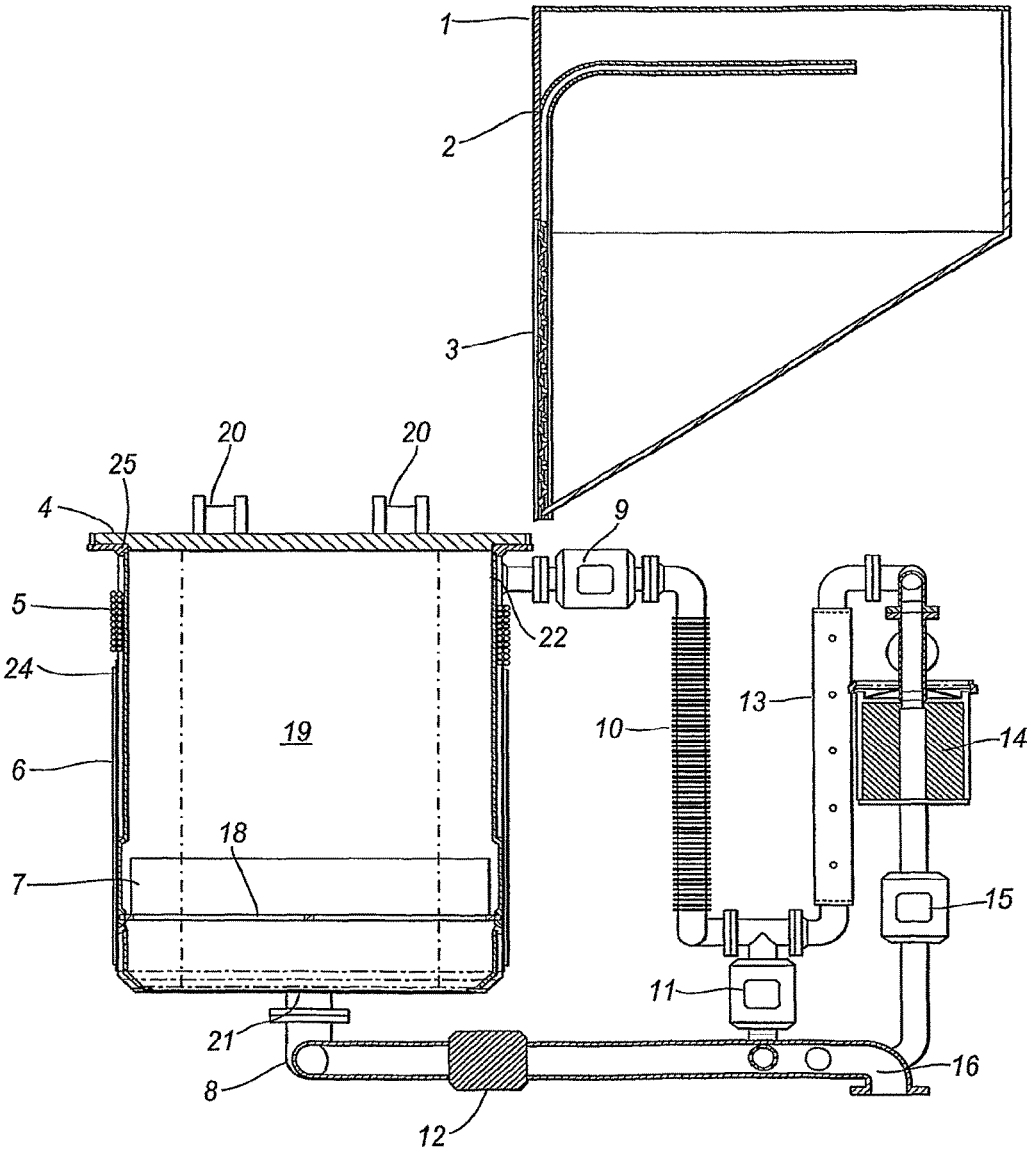
FIG. 1 shows a schematic cross-sectional view of a pyrolysis apparatus.
Figure 2:
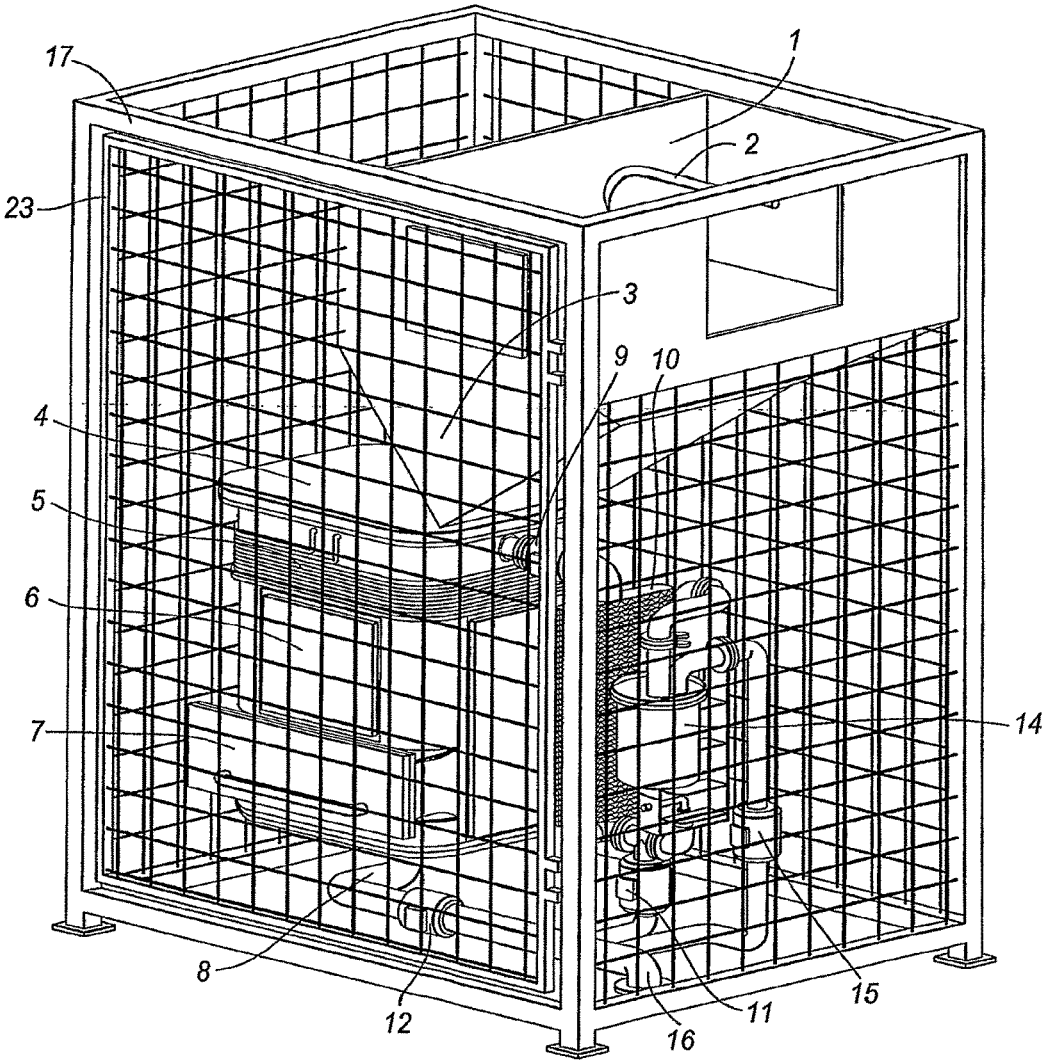
FIG. 2 shows schematic isometric view of the apparatus.

Referring to the drawings, a pyrolysis apparatus has the following features:—

PARTS LIST AND KEY

1. Storage Chute
2. Loading Door Mechanism
3. Loading Door
4. Lid
5. Air/water tubes
6. Heating Plates
7. Access Drawer
8. Chamber Exhaust (liquid)
9. Gas Exhaust Control Valve
10. Gas Cooling Radiator
11. Liquid Bleed Valve
12. Liquid Exhaust Control Valve
13. Wet Scrubber
14. Filtration System
15. Filtration Return-Protection Valve
16. Exit to Foul Water
17. Cage
18. Mesh
19. Treatment zone
20. Hinges
21. Exit Port for Liquid
22. Exit Port for Gas
23. Access Door to Cage
24. Chamber
25. Sealing Plate
Loading Sensor (not shown)
Seals (not shown)
Lid Cooler (not shown)
Insulation for chamber (not shown)
Water Jacket on Chamber (not shown)
Air Compressor (not shown)
Air tank (not shown)
Water Pump (not shown)
Water Header Tank (not shown)
Gas Flare (not shown)

Main Components:

Heating Chamber

The chamber (24) is manufactured from stainless steel (Austenitic Chromium-Nickel Steel) grade 316. Other materials, e.g. titanium, can be used. The weld material used in fabrication retains the corrosion resistant properties of the main body of the chamber. The chamber is resilient to the frequent heating/cooling cycles, and the material requires a heat treatment and finishing process within its manufacture.

The chamber has dimensions of 450×450×700 mm, with a wall thickness of 1.5 mm (the walls can also be up to 4 mm thick). On the top face of the chamber is a flat sealing plate (25) which is ground to a flat surface (+/−0.1 mm max) across the top surface. The chamber also features two outlets, an exit port (21) leading to an exhaust (8) at the base for liquid waste (approx 60 mm dia) and an exit port or outlet (22) at the top of one of the sides for the gas and vapour (approx 38 mm dia).

Lid

The lid (4) is manufactured from a similar material as the heating chamber, although it is manufactured from a flat plate. The surface is finished so the lid and chamber form a critical sealing surface. The lid is also reinforced on its rear to avoid any warping or distortion due to repetitive heating and cooling cycles. The lid is designed to be as robust as possible. The lid houses the hinge mechanism (20) on its rear and gives a mating surface for sealing on its underside. The lid also contains the seals (discussed below). The lid features an integrated water cooling surface (not shown) which runs around the rim of the lid, directly above the seals. This prolongs the product life cycle.

Seals

PTFE coated silicone rubber seals (not shown) are used to seal any non-permanent mating faces, such as the chamber lid and access drawer. All other mating surfaces feature a soft metal gasket arrangement.

Access Drawer

The drawer (7) is used to remove any incompatible materials that have not been decomposed by the process. The drawer features a water cooling circuit (not shown) similar to the lid that is used to cool the mating surfaces of the seat. The working surface of the drawer is a fine mesh (18) of a 3 mm aperture (up to a 5 mm aperture can also be used) which allows movement of solids, liquids and gases in the system. The drawer also features a sensor that informs the operator that the drawer has reached a certain predetermined capacity, and requires emptying.

Heating Elements

Flat plate heaters (6) are used on all four vertical sides of the chamber. The heaters are assembled to give maximum contact with the outside of the chamber.

Air/Water Tubes

The tubes (5) are used to pass water and air around the outer surfaces of the chamber. This is performed to preheat the waste prior to direct injection of the superheated air and steam at the latter phases of the process. The tubes are manufactured from Stainless Steel material (Inconel™ material can also be used), of 5 mm diameter.

Heat Insulation

On the outside of the heaters are many efficient insulating layers (not shown) which work to both reflect heat back into the chamber and reduce heat emissions to the outer surfaces of the assembly. This insulation ensures that all heating energy is used in a useful way to directly heat the waste product.

On the underside of the lid is a layer of ceramic plate (not shown) (5 mm thick) which is bonded onto the stainless steel lid. This reduces external heat loss and increases the product lifespan of seals etc.

Cooling Radiator

The radiator's primary function is to cool the gas which has been emitted from the product, prior to any filtration. The cooling prolongs the life and retains maximum efficiency of the filtration equipment.

The radiator (10) consists of a 38 mm tube (or same diameter as the chamber gas exhaust), which is bent in 2 axes. Fine horizontal fins are welded to the outside of the tube to increase heat loss of the passing gases. This reduces the exhaust gases from temperatures in the region of 600° C. down to 200° C. or below.

Wet Scrubber

The wet scrubber (13) is placed after the gas radiator in the system and removes particulate matter from the passing gases and dissolves gases in the scrubbing liquid for disposal subsequently. Inside the scrubbing device is a series of stacked jets producing a very fine mist of water. The mist attracts particulates to the outer surfaces of the mist droplets, and these are 'pulled out' of the gas flow and into the liquid waste stream. Within the scrubber is a series of openings which guide the flow of the waste gases directly past the mist jets.

Purification Systems

A ceramic filter (14) is preferably used. This cleans the exhaust gases prior to release to the foul water system. The filter screws onto a fixed manifold having a rubber seal which mates onto the manifold. Gases pass into the centre of the filter via a tube with an external thread which secures the filter to the manifold. The gases pass through the porous membrane of the filter and through to the return tube in the manifold. In normal use, the filter is replaced approximately every year. In alternative embodiments an actived carbon filter is used, this is replaced approximately every 90 days.

Waste Gas Flare

After the purification systems there is optionally a small gas flare outlet to burn off any flammable gas by-products from the waste. The flare is sited and specified so that it does not compromise safe and secure operation of the unit. However, in preferred embodiments a waste gas flare is not required due to the combination of low processing temperatures and gas cleaning systems.

Other Key Components:

Loading Chute

The chute (1) is fabricated from a corrosion resistant material. It has a storage capacity less than the chamber, eliminating the possibility of overloading.

There is a sensor (not shown) within the chamber which records the level that the waste has been loaded to, and when this level has been reached a separate solenoid/mechanism arrangement (not shown) locks off access to the system via the external chute. The chute also features an access door (not shown) which allows an operator to manually load the system on demand.

Cage

The system is housed within a cage (17). The framework has castors (not shown) to allow the unit to be removed easily due to a breakdown etc. The cage also has fixed outlets (not shown) for all services needed—foul water, fresh water and 3 phase (single phase may be used if feasible) electricity. Services are simply plugged in and are easily disconnected.

There is a lockable front access door (23) which allows an operator to perform basic maintenance tasks. The cage also protects equipment from vandalism.

Chamber Water Jacket

On the outside of the chamber and lid insulation there is a water jacket (not shown). This ensures that the insulation and chamber do not overheat and it gives the system the ability to cool rapidly on demand.

Control Electronics

A programmable logic controller (PLC) (not shown) controls the operation of the system, and monitor sensors (not shown) that are positioned throughout most mechanisms and active components within the system. All electronics are housed within a weatherproof enclosure (not shown), and positioned at a low point in the cage.

Air Compressor

An air compressor (not shown) is used to run the pneumatic cylinders (not shown) that open and close the lid and chute door and to provide air to be injected for combustion. The compressor is also used in transporting air through the tubes on the outside of the chamber for the air injection phase in the cycle. The compressor feeds a reservoir tank (not shown) which allows the system to have a certain capacity of stored air. This means that the compressor is not constantly running, which improves the life cycle of the unit. The compressor is also housed in a sealed enclosure (not shown) to ensure low noise emissions.

Water Pump

A pump is used to move water from a header tank and around the system, feeding components such as the cooling circuit, water jacket and the water injection feed into the heating chamber (24).

Valves

A network of high spec valves (9, 11, 12, 15) is used to control and throttle the flow of liquid and gas between the chamber, exhaust, radiator, wet scrubber and purification systems and to enable periodic change of water in the scrubber. These are controlled remotely by the programmable logic controller.

Process Cycle

1. Loading of Waste

The chamber lid is opened and the waste enters the chamber (which is at ambient temperature) via the storage chute. The lid is then closed and the chamber is sealed.

2. Heating

The panel heaters are activated and the interior temperature is raised to between 500-550° C. The liquid exhaust valve is closed and the emitted gases during the heating phase are passed through the cooling and purification system.

The temperature ramping period takes approximately 5-10 minutes, after which time the temperature is maintained via a thermostat. Due to the efficiency of the chamber insulation the power applied to the heaters is throttled to maintain the interior chamber temperature.

The gases produced by the waste are monitored and the moisture in the waste is emitted as a vapour and passed to the exhaust. The mass of a full load of typical waste reduces by approximately 70%.

The temperature is held for approximately 30 minutes.

3. Air Injection (Also Known as the Combustion Phase)

After the heating phase has completed the external panel heaters are turned off and air is passed through the tubes around the outside of the chamber (which preheats the air to a superheated temperatures) and injected into the top of the chamber. The injectors are such that the air is sprayed as a widely dispersed stream, as opposed to a concentrated jet. The air is initially pulsed to reduce stress in the system, and after a certain period the air is injected constantly.

The flow rate of the air is kept to around 50 l/min (rates of from 25 to 100 i/min, and also outside these ranges may be used, depending on system size and configuration). This low rate is maintained to ensure that internal pressure levels within the chamber are not increased too rapidly, as this will compromise the effectiveness of the seals.

With the introduction of air, the waste begins to glow. The volume of the waste decreases further, typically reaching around 5% of its original volume. The waste is converted to a very fine ash.

Smoke and particulate levels in the system increase during the air injection phase. All gaseous exhausts are passed through the wet scrubber and through the purification system. The combustion phase lasts approximately 15 minutes.

6. Steam Injection

When the combustion phase has completed the air injection is turned off, the gas exhaust valve is closed, the liquid exhaust valve is opened and water flows through the same tubes as the air, around the outside of the chamber and is injected as superheated steam. The steam is initially injected in a series of pulses, then as a constant stream. The pulses are 1 second on, 3 seconds off for 30 pulses, then continuously on for 3 minutes. The water is injected at approximately 2 l/min.

The steam both flushes the ash out through to the exhaust, and cleans the internal faces of the chamber. The steam has a cooling effect on the chamber, and after approximately 1 minute the internal temperature of the chamber drops to below 100° C. After the steam injection has completed the lid opens and the system is ready for its next cycle. Any incompatible waste that has not been decomposed by the cycle is held in the drawer, and can be removed and recycled.

EXAMPLE 1

Apparatus of the invention was tested for its ability to treat domestic waste whilst ensuring that gas and water emissions did not exceed the limits imposed by environmental legislation.

A mixed bag of waste was prepared, based on analysis of typical breakdown of domestic waste, containing 100 g garden waste, 100 g paper and cardboard, 200 g PVC, 300 g meat by-products and table salt and 100 g polyester, making a total weight of 800 g mixed waste.

This mixed waste was treated in apparatus of the invention using parameters determined to provide waste destruction in a relatively short period of time, these parameters being a pyrolysis temperature of 550° C. for 75 minutes followed by combustion with an air flow of from 40-50 liters/min for 15 minutes followed by steam injection to wash the ash residue into the water collection tank (the tank being used in the emissions test instead of a sewer connection).

This treatment was found to destroy all of the mixed waste, i.e. convert it all to ash which was flushed from the chamber with the steam/water.

Testing of the off-gases gave the following results:—

TABLE 1

| | Off-gas data | | |
|---|---|---|---|
| | NO (NO*x*) mg/m$^3$ | SO*x* mg/m$^3$ | HCL mg/m$^3$ |
| Ex. 1 | 6 | 185 | <47 |
| Limit stipulated by environmental legislation | 400 | 200 | 60 |

Separately, the wet scrubber water, to be discharged to the sewer in normal operation, was tested for levels of heavy metals and dioxins with the following results:—

TABLE 2

| | Off-water Data | | | | | | | |
|---|---|---|---|---|---|---|---|---|
| | Thallium | Mercury | Arsenic | Cadmium | Chromium | Lead | Nickel | Dioxins |
| Ex. 1 | 0.002 | 0.04 | 38.5 | 1.4 | 25.7 | 125 | 127 | 0.01 |
| Limit stipulated by environmental legislation | 0.05 | 0.03 | 150 | 50 | 500 | 200 | 500 | 0.3 |

Hence, the off-gases and the off-water were inside the emissions limits stipulated in the environmental legislation.

The invention hence provides treatment of waste by pyrolysis and apparatus for doing so.

The invention claimed is:

1. A process for waste treatment comprising:

introducing waste into a chamber;

heating the waste to an elevated temperature to effect pyrolysis of the waste, then as the next step;

introducing oxygen into the chamber to effect combustion of the waste;

after combustion is completed, admitting water and/or steam in pulses into the chamber to cool the chamber, and flushing the combusted waste from the cooled chamber with water;

wherein the temperature to effect pyrolysis is from 400-700° C. and the temperature to effect combustion is at least 400° C.

2. A process according to claim 1, wherein the temperature to effect pyrolysis is from 500-600° C.

3. A process according to claim 1, comprising holding the waste at the elevated temperature until 50% or more of the waste is degraded by pyrolysis.

4. A process according to claim 1, wherein the temperature to effect combustion is at least 450° C.

5. A process according to claim 1, wherein the temperature to effect combustion is at least 500° C.

6. A process according to claim 1, wherein the temperature to effect combustion is not more than 800° C.

7. A process according to claim 1, wherein the combusted waste is flushed through a grid to trap recyclable material.

8. A process according to claim 7, wherein the grid is moveable, and the method comprises moving the grid between a first position in which the grid traps the recyclable material and a second position in which the recyclable material can be transferred into a receptacle.

9. A process according to claim 1, comprising flushing the combusted waste from the chamber into a sewage system.

10. A process according to claim 1, wherein the maximum volume of the chamber is 0.5 $m^3$.

11. A process according to claim 1, wherein waste gases produced during the process are passed through a wet scrubber.

12. A process according to claim 1, wherein waste gases produced during the process are passed through an aqueous agitation system.

13. A pyrolysis and combustion apparatus, comprising:

a sealable chamber;

a waste treatment zone in the chamber;

a port for introducing waste into the chamber;

a port for the exit of treated waste;

a heating element;

an injector for cooling the chamber using water and/or steam injected in pulses;

a port for admitting water to flush the chamber; and a control system configured to carry out a process according to claim 1.

14. An apparatus according to claim 13, wherein the chamber comprises an output for connection to a sewer so that the treated waste can be flushed into the sewage system.

15. An apparatus according to claim 13, further comprising a tank to contain a gas treatment solution, an exhaust port for exit of gases from the chamber and a conduit arranged in combination with the tank and the exhaust port to contact the gases with the solution.

16. An apparatus according to claim 13, further comprising a grid between the waste treatment zone and the exit port.

17. An apparatus according to claim 13, wherein the maximum volume of the chamber is 0.5 $m^3$.

18. An apparatus according to claim 13, wherein waste gases produced during the process are passed through at least one of a wet scrubber and an aqueous agitation system.

19. A process for waste treatment comprising:

introducing waste into a chamber, wherein the maximum volume of the chamber is 0.5 $m^3$, heating the waste to an elevated temperature to effect pyrolysis of the waste, then as the next step introducing oxygen into the chamber to effect combustion of the waste, after combustion is completed, admitting water and/or steam in pulses into the chamber to cool the chamber, and flushing the combusted waste from the chamber with water.

20. A pyrolysis and combustion apparatus, comprising:

a sealable chamber, wherein the maximum volume of the chamber is 0.5 $m^3$, a waste treatment zone in the chamber, a port for introducing waste into the chamber, a port for the exit of treated waste, a heating element, means for cooling the chamber using water and/or steam injected into the chamber in pulses;

means for admitting water to flush the chamber; and a control system configured to carry out a process according to claim 1.

* * * * *